US011306482B1

(12) United States Patent
Bennett et al.

(10) Patent No.: US 11,306,482 B1
(45) Date of Patent: Apr. 19, 2022

(54) FIELD-RESIZABLE SLAB ANCHOR THAT USES CUT-TO-LENGTH PIPE

(71) Applicants: Brent Bennett, Gold Canyon, AZ (US); Nick Merriman, Jr., Seattle, WA (US)

(72) Inventors: Brent Bennett, Gold Canyon, AZ (US); Nick Merriman, Jr., Seattle, WA (US)

( * ) Notice: Subject to any disclaimer, the term of this patent is extended or adjusted under 35 U.S.C. 154(b) by 0 days.

(21) Appl. No.: 17/215,445

(22) Filed: Mar. 29, 2021

(51) Int. Cl.

| | |
|---|---|
| ***E04C 5/16*** | (2006.01) |
| ***E04B 1/41*** | (2006.01) |
| ***E04G 21/14*** | (2006.01) |
| ***E04B 1/35*** | (2006.01) |

(52) U.S. Cl.
CPC ..... *E04C 5/166* (2013.01); *E04B 1/3511* (2013.01); *E04B 1/41* (2013.01); *E04G 21/142* (2013.01); *E04B 2001/4192* (2013.01)

(58) Field of Classification Search
CPC ..... E04C 5/166; E04B 1/3511; E04B 1/41; E04B 2001/4192; E04G 21/142
USPC ..... 52/125.4
See application file for complete search history.

(56) References Cited

U.S. PATENT DOCUMENTS

| | | | | |
|---|---|---|---|---|
| 3,216,171 | A * | 11/1965 | Jenkins | E04B 1/4121 52/127.3 |
| 3,590,538 | A * | 7/1971 | Holt | F16B 13/00 52/127.3 |
| 4,325,575 | A * | 4/1982 | Holt | B66C 1/666 294/89 |
| 4,679,362 | A * | 7/1987 | Mess | E04G 21/142 52/125.5 |
| 4,785,593 | A * | 11/1988 | Munoz, Jr. | E02D 27/42 52/126.1 |
| 9,347,232 | B1 * | 5/2016 | Francies, III | E04G 15/04 |
| 9,863,158 | B1 * | 1/2018 | Adam | E04F 21/05 |
| RE46,831 | E | 5/2018 | Francies | |
| 10,060,144 | B1 * | 8/2018 | Francies, III | E04G 21/1841 |
| 10,752,472 | B2 * | 8/2020 | Connell | E04B 1/3511 |
| 10,774,523 | B2 * | 9/2020 | Reuter | E04B 1/41 |

(Continued)

FOREIGN PATENT DOCUMENTS

KR 20020094643 A * 12/2002

OTHER PUBLICATIONS

Meadow Burke, "B-75 Wall Brace Insert", undated (1 page).

(Continued)

*Primary Examiner* — Adriana Figueroa
(74) *Attorney, Agent, or Firm* — Arc IP Law, PC; Joseph J. Mayo

(57) ABSTRACT

A slab anchor that is resizable in the field to accommodate different thicknesses of slabs. The anchor may have a top assembly and a bottom assembly that are joined by pipe such as widely available PVC pipe. A contractor can simply determine the desired width of the slab (which determines the height of the anchor) and cut a PVC pipe to the length necessary to make a slab anchor of the needed height. This system allows contractors to keep on hand only a single type of slab anchor, and to customize this anchor easily at the last minute for each slab. The top assembly of the anchor may have a coil that a fastener screws into after the concrete is poured; a coil protector screw may be placed into the coil during pouring so that concrete does not fill the coil, and removed thereafter to install the fastener.

11 Claims, 6 Drawing Sheets

(56) References Cited

U.S. PATENT DOCUMENTS

| | | | | |
|---|---|---|---|---|
| 2008/0209829 | A1* | 9/2008 | Lucas | E04H 4/10 52/302.7 |
| 2013/0067849 | A1 | 3/2013 | Espinosa | |
| 2018/0023296 | A1* | 1/2018 | Recker | E04F 15/00 52/126.6 |
| 2019/0048532 | A1* | 2/2019 | Smith | E01C 5/001 |
| 2019/0169835 | A1 | 6/2019 | Gilman | |

OTHER PUBLICATIONS

Meadow Burke, "B-75 Wall Brace Insert", undated (1 page), retrieved from meadowburke.com.
SureBuilt Concrete Forms & Accessories, "Brace Insert", dated Nov. 2020 (2 pages).
Dayton Superior Corporation, "T6a and T6S Brace Anchor", 2020 (3 pages).
Dayton Superior Corporation, "T6A and T6S Brace Anchor-Tilt-Up Anchor", Nov. 19, 2018 (2 pages) and Size Options (1 page).

* cited by examiner

FIELD-RESIZABLE SLAB ANCHOR THAT USES CUT-TO-LENGTH PIPE

BACKGROUND OF THE INVENTION

Field of the Invention

One or more embodiments of the invention are related to the field of construction fixtures. More particularly, but not by way of limitation, one or more embodiments of the invention enable a field-resizable slab anchor that uses cut-to-length pipe.

Description of the Related Art

Slab anchors for concrete slabs or similar slabs are known in the art. These anchors are typically installed into a frame and a concrete slab is poured over them; then a fastener such as a bolt can be attached to the slab anchor. Slab anchors must be sized to the thickness of the slab, since they effectively span the full height of the slab so that a fastener can be installed into the anchor. Existing slab anchors are therefore stocked in multiple sizes to accommodate different slab thicknesses. This solution is effective, but it is inconvenient for vendors and for contractors. Contractors in particular may find that they need to have on hand a wide variety of slab anchor sizes, or they may learn at the last minute that they do not have an appropriately sized anchor for the slab they are pouring, thereby delaying construction. It would be extremely convenient to have a slab anchor that is easily resizable in the field using common construction materials that are readily available, such as PVC pipe that can be easily cut to a desired length.

For at least the limitations described above there is a need for a field-resizable slab anchor that uses cut-to-length pipe.

BRIEF SUMMARY OF THE INVENTION

One or more embodiments described in the specification are related to a field-resizable slab anchor that uses cut-to-length pipe. Embodiments of the invention may allow adjustment of the size of a slab anchor by inserting a pipe cut to the desired length, such as a PVC pipe for example, between two subassemblies of the anchor that are common for all slab heights. This solution allows contractors to accommodate any slab thickness by stocking only a single type and size of slab anchor.

In one or more embodiments, a slab anchor may have an anchor, a coil protector screw, a coil protector nut, and a base. A cut-to-length pipe may be inserted between the base and the lower end of the coil protector nut to form the desired slab height. The anchor may include a coil whose inner surface accepts a threaded fastener (such as a coil bolt) after pouring the slab; one or more arms may be attached to the outer surface of the coil, extending radially outward. The coil protector screw may have a threaded element that screws into the coil from the upper end of the coil. The coil protector nut may have an upper section with a threaded hole that accepts the lower portion of the threaded element of the coil protector screw. The lower section of the coil protector nut may for example fit inside the inner surface of the upper end of the pipe. The base may have a hole into which the outer surface of the lower end of the pipe fits; it may also have one or more feet.

In one or more embodiments, the pipe may be a PVC pipe, such as a ¾ inch schedule 40 PVC pipe.

In one or more embodiments the coil protector screw and the coil protector nut may be made of nylon. In one or more embodiments the coil may be made of steel. In one or more embodiments the base may be made of polypropylene.

In one or more embodiments, the outer surface of the lower section of the coil protector nut, and the inner surface of the hole in the bae may have one or more protrusions that increase the tightness of fit with the pipe.

In one or more embodiments the coil protector screw may have a cap at the upper end of the threaded element; the cap may have a slot. The horizontal cross section of the slot may be square. One or more embodiments may include a plug that fits into the slot. The plug may be made of low-density polyethylene.

In one or more embodiments there may be one or more antennas that extend vertically upward from the top surface of the cap of the coil protector screw.

One or more embodiments may have an upper seal that fits between the cap of the coil protector screw and the upper end of the coil, and a lower seal that fits between the upper section of the coil protector nut and the lower end of the coil. The seals may be for example annular shapes. They may for example be made of foam.

In one or more embodiments, the maximum load placed on the anchor when the anchor is embedded in concrete, and when a threaded fastener is inserted into the coil and placed in tension, does not change substantially based on the length to which the pipe is cut.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A field-resizable slab anchor that uses cut-to-length pipe will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
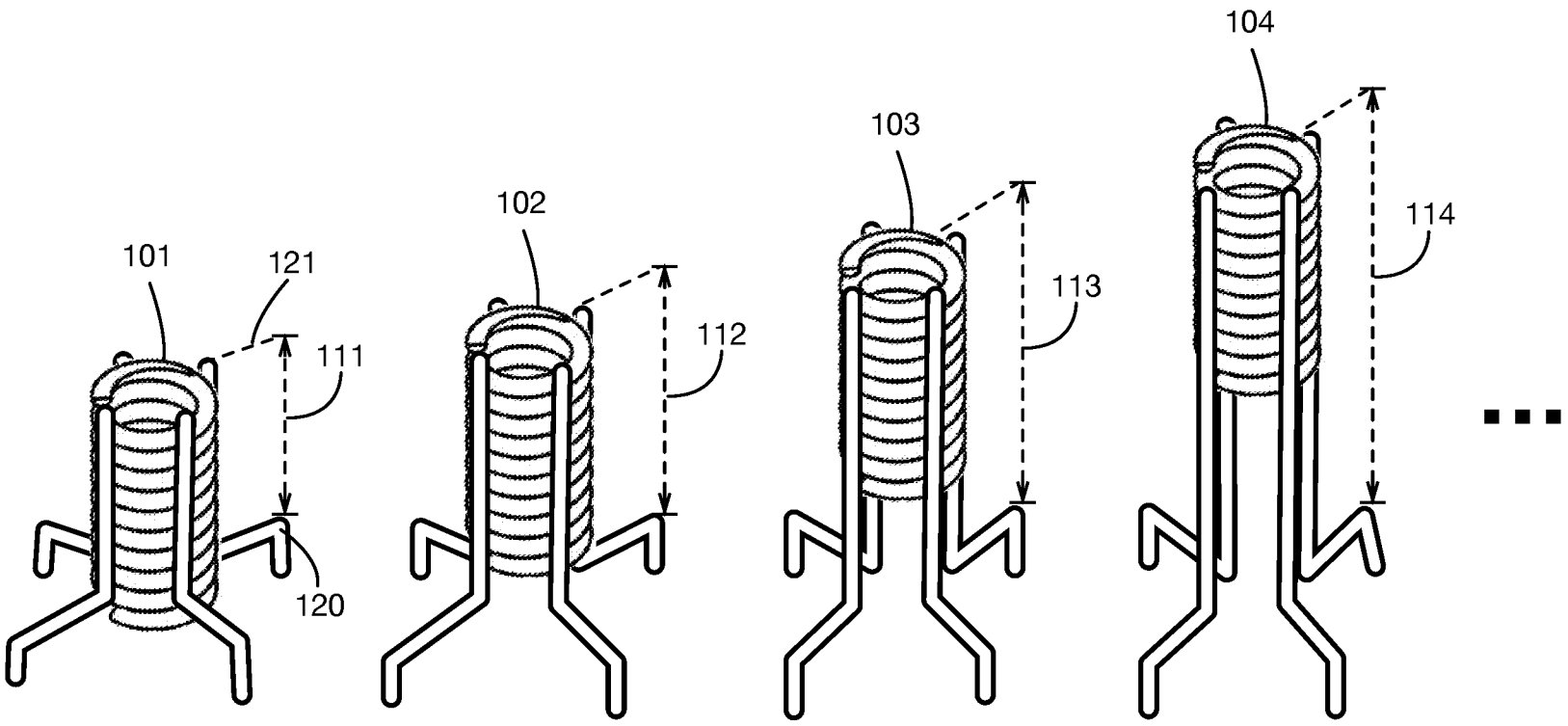
FIG. 1 PRIOR ART
FIG. 1 shows illustrative slab anchors similar to those available in the prior art that must be stocked in a large number of sizes to accommodate different slab thicknesses.

FIG. 1 shows a small portion of an illustrative large range of slab anchors 101, 102, 103, and 104 in the prior art. These slab anchors are manufactured in different height to accommodate different slab thicknesses. For example, anchor 101 may be used for a relatively thin slab, and anchor 104 may be used for a much thicker slab. In this illustrative example, the coil of each anchor is a common part, but the legs come in varying lengths. Because the legs are typically rigidly joined to the coil, each variation must be manufactured separately. Contractors must stock or order sizes based on specific slab thicknesses. This increases the complexity and expense of their inventory, and it creates a risk of not having the correctly sized slab anchor on hand on site, causing last-minute delays.

Table 1 below shows an illustrative range of sizes that a typical vendor of slab anchors may offer. (This data is illustrative and does not correspond to any specific vendor.) In this example, 20 different models of slab anchor are offered, and the correct size or sizes must be pre-ordered for each project.

TABLE 1

| Slab Anchor Item Number | Slab Thickness, Inches | Maximum Load, lbs |
|---|---|---|
| Z202000 | 5" | 6,000 |
| Z202005 | 5½" | 7,200 |
| Z202010 | 6" | 8,150 |
| Z202015 | 6¾" | 9,000 |
| Z202020 | 6½" | 10,250 |
| Z202025 | 7" | 12,000 |
| Z202030 | 7¼" | 13,100 |
| Z202035 | 7½" | 14,300 |
| Z202040 | 8" | 15,900 |
| Z202045 | 8¼" | 16,600 |
| Z202050 | 8½" | 17,800 |
| Z202055 | 9" | 18,300 |
| Z202060 | 9¼" | 19,100 |
| Z202065 | 9½" | 19,900 |
| Z202070 | 10" | 20,500 |
| Z202075 | 10½" | 20,800 |
| Z202080 | 11" | 21,400 |
| Z202085 | 11¼" | 22,100 |
| Z202090 | 11½" | 22,900 |
| Z202095 | 12" | 23,500 |

Table 1 also shows the maximum load (in tension) that can be applied to a fastener attached to each anchor when the anchor is embedded in concrete. For anchors in the prior art, the maximum load generally increases as the height of the anchor increases. This variable maximum load occurs because the distance between the top of the slab and the holding "legs" of each anchor varies with anchor sizes; therefore there is more width of concrete holding down the legs of a taller anchor, and the maximum load increases. Referring to FIG. 1, for the shortest anchor 101, the vertical distance 111 from the top of leg 120 (and the other legs) to the approximate level 121 of the top of the slab when the anchor is embedded in a slab is shorter than the corresponding distances 112, 113, and 114 for the taller anchors 102, 103, and 104, respectively. Therefore the maximum load for this smallest anchor 101 will be smaller than that of the other anchors, and the maximum load increases for each increase of anchor height from anchor 101 to anchor 104.

Figure 2B:
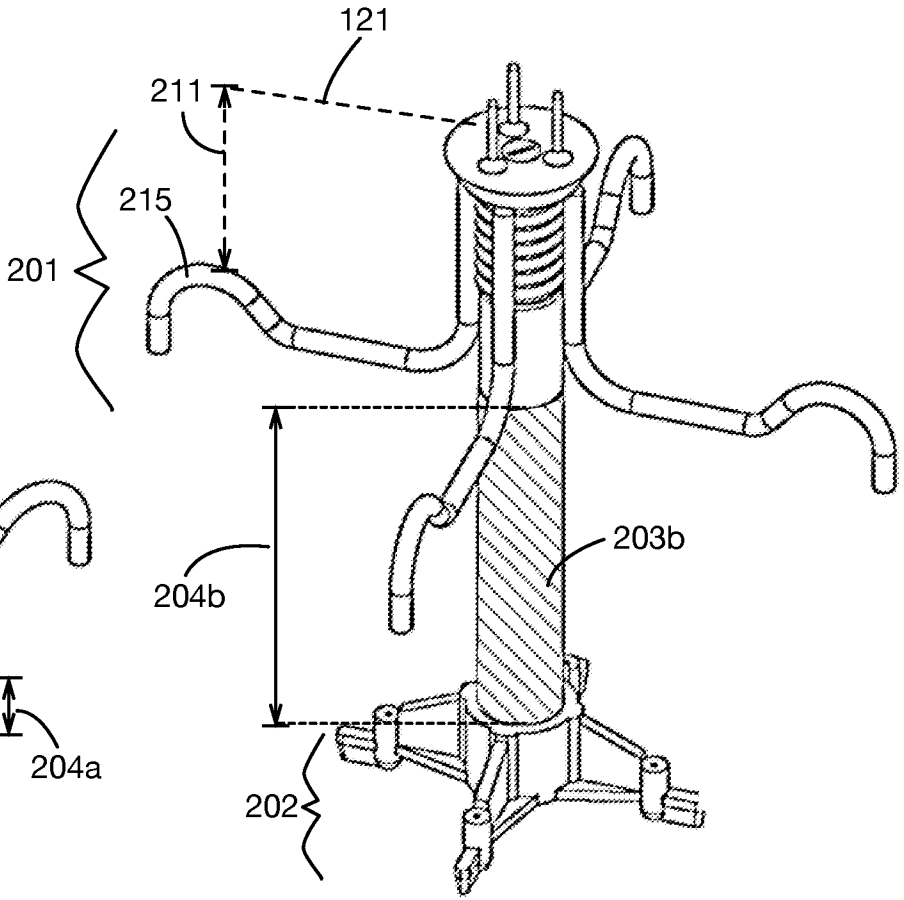
FIGS. 2A and 2B show two different configurations of an embodiment of the invention, which are sized by installing an appropriate length PVC pipe between the top and bottom assemblies; contractors therefore only need to stock a single size of the top and bottom assembly and can easily customize the anchor height in the field.
Figure 2A:
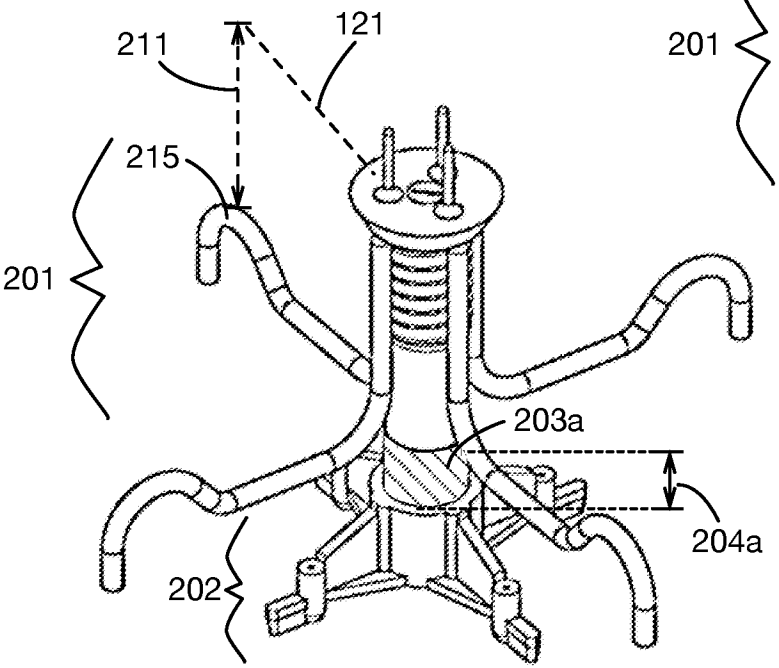

FIGS. 2A and 2B show different size configurations of an embodiment of the invention. In this embodiment, the slab anchor has a top assembly 201 and a bottom assembly 202, which only need to be stocked in a single size. The final height of the slab anchor is determined by the length of a pipe, such as a PVC (polyvinyl chloride) pipe, that is installed between the top and bottom assemblies. This installation can be performed easily in the field, so that contractor can size the anchor at the last minute based on the desired slab thickness. PVC pipe in particular is inexpensive and widely used, so it is likely readily available at most construction sites or can be quickly and easily obtained. PVC pipe (or similar pipe) can be easily cut to size using simple tools.

In FIG. 2A, a short section 203*a* of pipe, of length 204*a*, is cut and used to join top assembly 201 to bottom assembly 202. In FIG. 2B, a longer section 203*b* of pipe, of length 204*b*, is cut and used to join top assembly 201 to bottom assembly 202. The resulting anchor heights in the examples of FIGS. 2A and 2B are therefore very different, but the same anchor parts 201 and 202 are used for both. Because contractors only need to keep on hand a single type of slab anchor (with parts 201 and 202), the expense and complexity of stocking parts is greatly reduced. The chance of missing a necessary slab anchor size on site is also eliminated, which may size significant time and cost that may otherwise result from construction delays while the necessary slab anchor size is obtained.

Another benefit of the embodiment of the invention illustrated in FIGS. 2A and 2B is that the vertical distance 211 from the top of "arm" 215 (and the other arms) to the top level 121 of a slab remains the same as the total anchor height changes. (Arm 215 serves the same holding function as leg 120 in FIG. 1.) Use of different pipe heights for pipes 203*a* and 203*b* to customize the anchor height does not affect this distance, since the arms are above the pipe. Therefore the maximum load of the anchor remains essentially constant, regardless of how the total height is adjusted to match the slab height. This constant maximum load may simplify construction and decision-making, and it reduces the risk that an anchor will be used inadvertently with a maximum load is too small for the requirements. This feature is not present in anchors in the prior art, as illustrated in Table 1 and in FIG. 1.

Figure 2C:
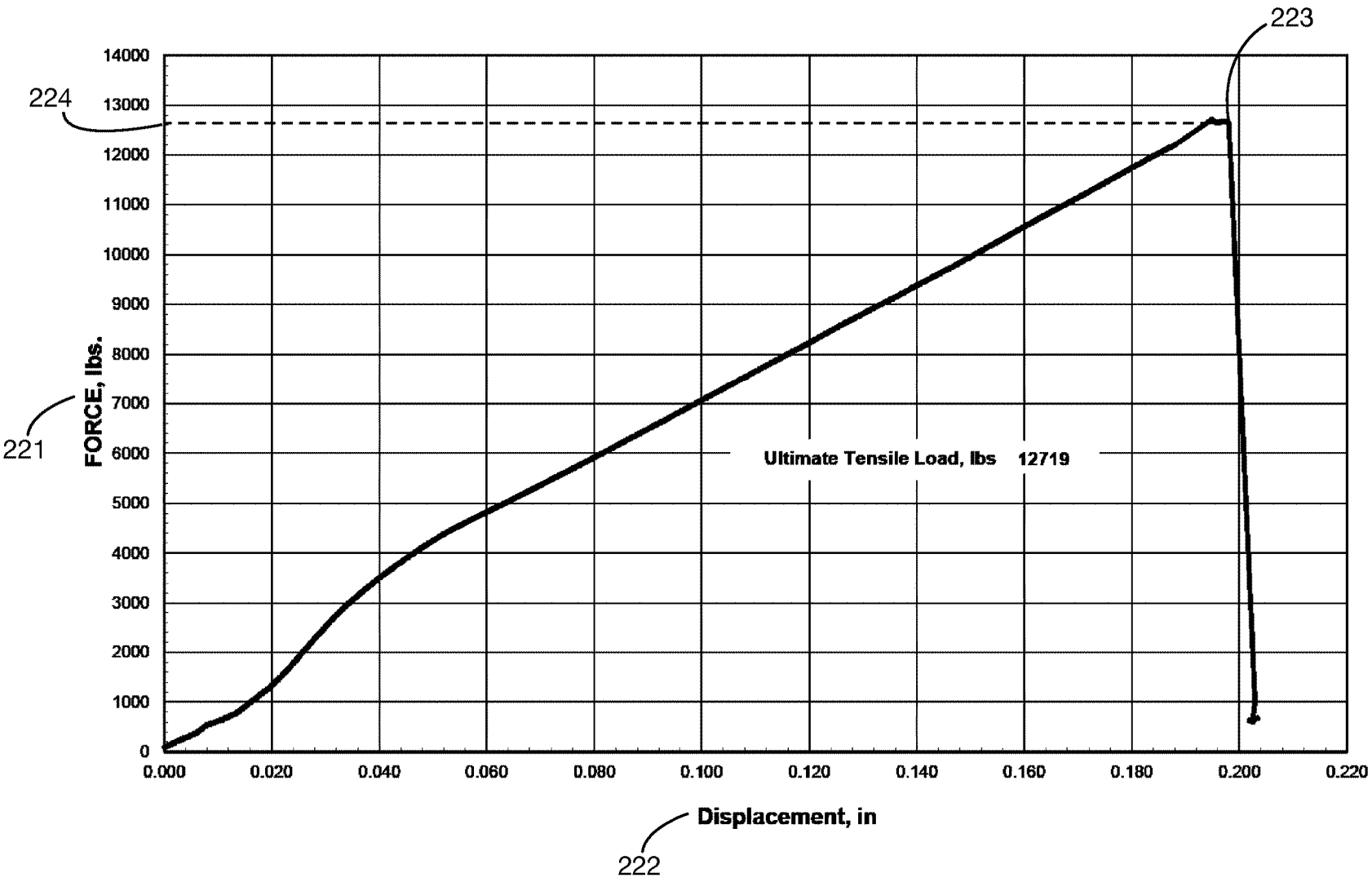
FIG. 2C shows results of a load test performed on an embodiment of the invention embedded in a concrete slab.

FIG. 2C shows the results of a load test performed by the inventors on the anchor shown in FIGS. 2A and 2B, embedded in a concrete slab. A fastener was inserted into the anchor, and placed in tension. The tension force 221 is plotted against resulting displacement 222. Failure occurs at point 223, which corresponds to an ultimate tensile load 224 for the anchor of 12,719 lbs. This value (or a similar value for other embodiments) can be quoted once for the anchor, regardless of the height to which the anchor is adjusted to fit a desired slab height.

Figure 3:
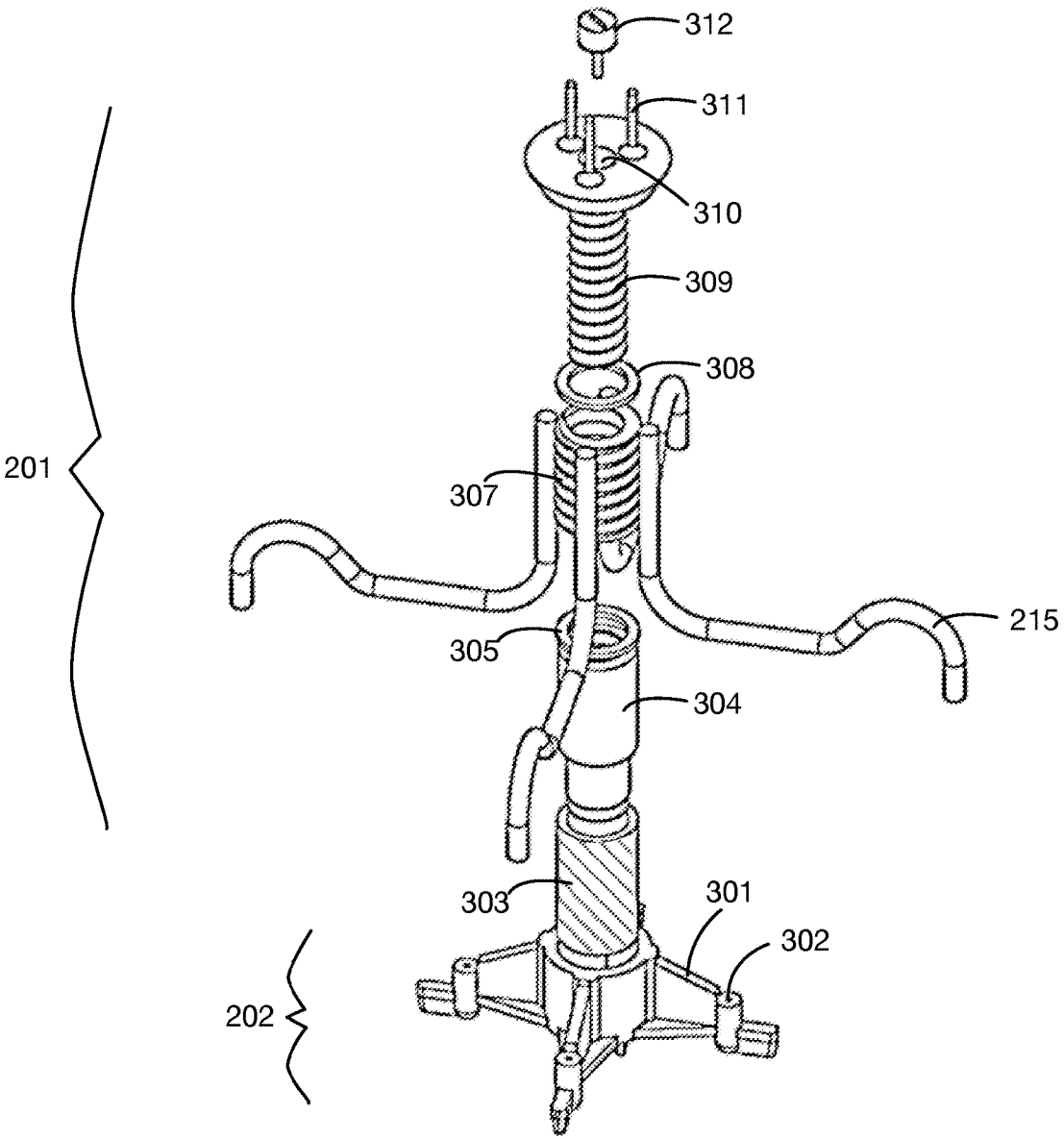
FIG. 3 shows an exploded view of the embodiment of FIGS. 2A and 2B.

FIG. 3 shows an exploded view of the embodiment illustrated in FIGS. 2A and 2B. The main anchor portion includes four arms such as arm 215, and a coil 307 in the middle of these arms. The arms are attached to the outer surface of coil 307 and extend radially outward. The arms brace against the poured concrete when the slab is poured. One or more embodiments may use any number of arms of any desired shape and size. A bolt or similar threaded fastener may be screwed into the coil after the slab is poured, as shown below in FIG. 5D. A coil offers a benefit over a threaded sleeve because bolt threads can cut into or expand the coil, so that slight mismatches in thread size, or contamination of the inner coil with small amounts of cement, do not prevent the bolt from being installed. The coil may for example be produce by winding coil wire tightly together. Illustrative specifications for the coil 307 are a pitch of 0.222 inches, 4.5 threads per inch, a root diameter of 0.63 inches average, and a major diameter of 0.745 inches average. This may be referred to for example as a ¾ inch coil thread. The coil may be made for example of steel.

Prior to pouring concrete, a coil protector screw 309 may be screwed into coil 307 from the upper end of the coil. The coil protector screw fills the inner part of the coil to keep out concrete when it is poured. An upper seal 308 made of a compressible material such as foam or rubber fits between the top cap of the coil protector screw and the top of coil 307 to seal the gap against ingress of concrete during pouring. The seal may be annular shaped. After the slab is set, the coil protector screw 309 may be removed, exposing the coil 307, and a bolt or similar fastener may be installed into the coil, as described below with respect to FIGS. 5C and 5D. A turnout slot 310 may be integrated into the top cap of coil protector screw 309 to facilitate removal of the coil protector screw. This slot 310 may be for example a square hole (with a square horizontal cross section) with a ⅜ inch square shape, which accommodates a ⅜ inch socket extension for a ratchet. Before pouring concrete, a coil protector removal plug 312 may be inserted into slot 310 so that concrete does not enter into the slot; this plug may be removed afterwards to expose the slot to remove the coil protector screw. Illustrative coil protector screw 309 has three antennas such as antenna 311 that stick up from the top of the cap of the screw; these antennas may for example help locate the top of the slab anchor if the cap of the coil protector screw is covered with concrete. The coil protector screw (and antennas) may be constructed for example of nylon 6/6, and coil protector removal plug 312 may for example be constructed of LDPE (low-density polyethylene).

Coil protector nut 304 screws onto the lower portion of coil protector screw 309 when this screw is installed in the coil. The upper inner surface of protector nut 304 may be threaded to accept threads of coil protector screw 309. A lower seal 305, which may be similar to upper seal 308, fits between the top of coil protector nut 304 the bottom of coil 307, to form a tight seal that keeps out poured concrete. The lower portion of protector nut 304 fits into a pipe 303, which is cut to the desired length to make the total height of the slab anchor assembly match the desired slab thickness. The protector nut may mate with the pipe 303 in any desired manner; for example, the lower portion of the protector nut may fit into the inner surface of the pipe, or the lower portion of the protector nut may have a hole that accepts the outer surface of the pipe. In the illustrative embodiment shown in FIG. 3, the lower portion of the protector nut 304 fits inside the inner surface of pipe 303. The outer surface of the lower portion of the protector nut may have fins or similar protrusions to make a tight fit with pipe 303. Coil protector nut 304 may be constructed for example from nylon 6/6.

PVC pipe (or similar tubular structure) 303 may be for example a standard ¾ inch Schedule 40 pipe, which is cut to length by the contractor for the height needed for the slab anchor. Such pipe may have for example an average inner diameter of 0.804 inches, and an average outer diameter of 1.05 inches. Use of PVC is illustrative; one or more embodiments may use pipe or similar elements of any material or materials.

The lower portion of PVC pipe 303 couples to the anchor base 301. This coupling may be done in any desired manner; for example, base 301 may have a hole into which the pipe fits (as illustrated in FIG. 3), or the base may have an element that fits into the inner surface of the pipe. The hole in the base (or other element) may have fins, ridges, or similar protrusions to wedge the pipe tightly into place when it is installed into the base. Base 301 has four feet, each of which has a hole 302 to accommodate a screw or nail that may hold the base against the floor of a slab frame. One or more embodiments may have any number of feet of any size or shape. Base 301 may be constructed for example of polypropylene.

Figure 4:
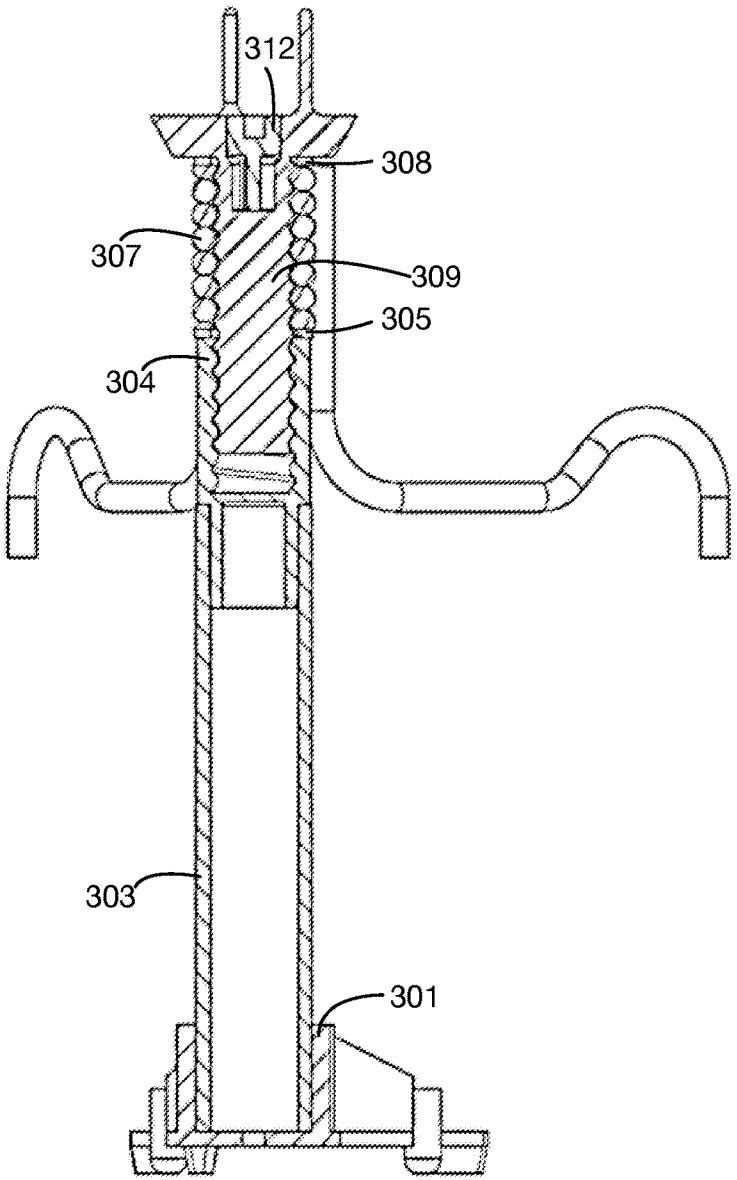
FIG. 4 shows a cross section view of the embodiment of FIGS. 2A and 2B.

FIG. 4 shows a cross sectional view of the fully assembled embodiment of FIGS. 2A and 2B through a vertical plane that passes through the center axis of the PVC pipe 303. Coil protector screw 309 is screwed into coil 307 and into inner threads in the top portion of coil protector nut 304. Coil protector removal plug 312 is installed into the turnout slot of the coil protector screw 309. Seal or gasket 308 seals the gap between the coil 307 and coil protector screw 309; seal or gasket 305 seals the gap between coil protector nut 304 and coil 307. PVC pipe 303 is forced tightly around the lower portion of coil protector nut 304 and tightly against the inner surface of the hole in base 301. The tight seals everywhere allow concrete to be poured completely around the slab anchor assembly without entry of concrete into the inner cavities of the coil or other parts.

FIGS. 5A through 5D show illustrative successive steps in using an embodiment of the invention with a concrete slab. In the first steps shown in FIG. 5A, a frame 501 is constructed into which concrete will be poured. An appropriate length of PVC pipe 303*a* is cut and used to join the upper and lower assemblies of the slab anchor, so that the height of the anchor (excluding the antennas) matches the desired slab thickness. The base of the slab anchor is secured to the floor of the frame, using for example nails or screws such as 503*a* and 503*b*. (With a four-footed base, up to four nails or screws may be used.)

Figure 5B:
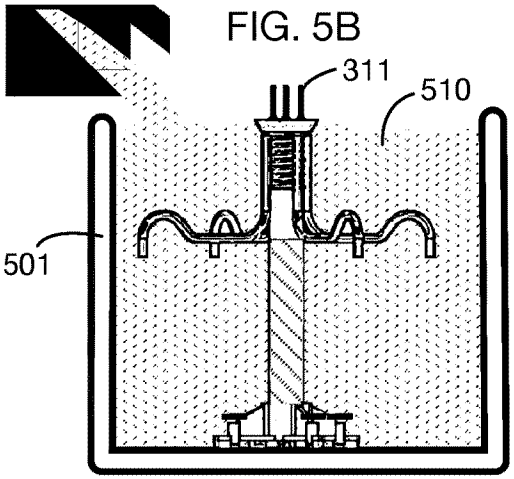
FIGS. 5A through 5D show illustrative steps in installing and using an embodiment of the invention.

Subsequently as shown in FIG. 5B, concrete (or similar material) 510 is poured into frame 501. When concrete has reached the desired height, it covers the entire anchor assembly, with antennas such as antenna 311 sticking out of the top.

Figure 5D:
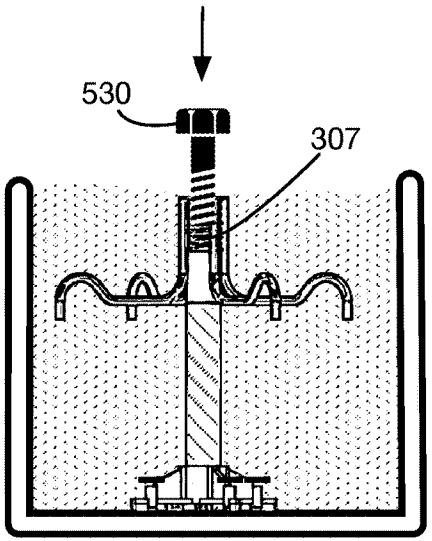
Figure 5A:
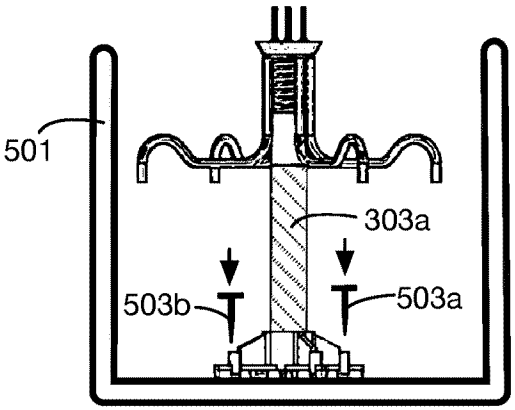
Figure 5C:
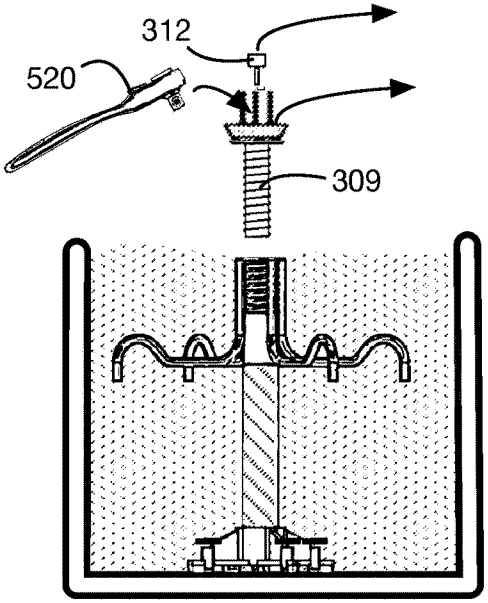

As shown in FIG. 5C, after the concrete is set, the coil protector removal plug 312 is removed, and a tool such as a socket wrench 520 is inserted into the slot of coil protector screw 309. The coil protector screw may then be removed from the coil.

In the final step shown in FIG. 5D, a bolt or similar fixture 530 is installed into the coil. This bolt may be for example a standard steel coil bolt with a hex head. Any desired structures may be bolted to, hung from, or suspended from the slab using this type of attachment. The slab anchor fixed in the concrete provides an extremely strong holding force for any of these structures.

While the invention herein disclosed has been described by means of specific embodiments and applications thereof, numerous modifications and variations could be made thereto by those skilled in the art without departing from the scope of the invention set forth in the claims.

What is claimed is:

1. A field-resizable slab anchor that uses cut-to-length pipe, comprising:

an anchor comprising a coil comprising an inner surface configured to accept a threaded fastener; and one or more arms coupled to an outer surface of said coil and extending radially from said coil;

a coil protector screw comprising a threaded element configured to screw into said coil from an upper end of said coil;

a cap at an upper end of said threaded element comprising a slot; and one or more antennas coupled to a top surface of said cap that extend vertically upward from said top surface of said cap;

a plug configured to fit into said slot;

an upper seal comprising an annular shape and configured to fit between said cap of said coil protector screw and said upper end of said coil;

a coil protector nut, comprising an upper section comprising a threaded hole configured to accept a lower portion of said threaded element of said coil protector screw; and a lower section coupled to said upper section and configured to fit inside an inner surface of an upper end of a pipe, wherein said pipe is configured to be cut to a desired length to achieve a desired slab anchor height; and an outer surface of said lower section of said coil protector nut comprises one or more protrusions configured to increase tightness of fit with said pipe;

a lower seal comprising an annular shape and configured to fit between said upper section of said coil protector nut and a lower end of said coil; and, a base comprising one or more feet; and a hole in said base configured to accept an outer surface of a lower end of said pipe, wherein an inner surface of said hole in said base comprises one or more protrusions configured to increase tightness of fit with said pipe.

2. The field-resizable slab anchor that uses cut-to-length pipe of claim 1, wherein a horizontal cross section of said slot comprises a square shape.

3. The field-resizable slab anchor that uses cut-to-length pipe of claim 2, wherein said pipe comprises polyvinyl chloride;

said coil protector screw further comprises nylon;

said coil protector nut further comprises nylon;

said plug comprises low-density polyethylene;

said coil further comprises steel;

said base further comprises polypropylene;

said upper seal further comprises foam; and, said lower seal further comprises foam.

4. The field-resizable slab anchor that uses cut-to-length pipe of claim 1, wherein said pipe comprises polyvinyl chloride.

5. The field-resizable slab anchor that uses cut-to-length pipe of claim 4, wherein said pipe comprises ¾ inch schedule 40 polyvinyl chloride pipe.

6. The field-resizable slab anchor that uses cut-to-length pipe of claim 1, wherein said coil protector screw further comprises nylon; and, said coil protector nut further comprises nylon.

7. The field-resizable slab anchor that uses cut-to-length pipe of claim 1, wherein said coil further comprises steel.

8. The field-resizable slab anchor that uses cut-to-length pipe of claim 1, wherein said base further comprises polypropylene.

9. The field-resizable slab anchor that uses cut-to-length pipe of claim 1, wherein said plug comprises low-density polyethylene.

10. The field-resizable slab anchor that uses cut-to-length pipe of claim 1, wherein said upper seal further comprises foam; and, said lower seal further comprises foam.

11. The field-resizable slab anchor that uses cut-to-length pipe of claim 1, wherein a maximum load placed on said anchor when said anchor is embedded in concrete, and when said threaded fastener is inserted into said coil and placed in tension, does not change substantially based on said desired length to which said pipe is cut.

* * * * *